US008226499B2

(12) United States Patent
Soracco

(10) Patent No.: US 8,226,499 B2
(45) **Date of Patent: *Jul. 24, 2012**

(54) GOLF CLUB HEAD WITH CONCAVE INSERT

(75) Inventor: Peter L. Soracco, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/185,324

(22) Filed: Jul. 18, 2011

(65) Prior Publication Data

US 2011/0275455 A1 Nov. 10, 2011

Related U.S. Application Data

(63) Continuation of application No. 12/696,468, filed on Jan. 29, 2010, now Pat. No. 7,980,964, which is a continuation of application No. 11/110,733, filed on Apr. 21, 2005, now Pat. No. 7,658,686.

(51) Int. Cl.
*A63B 53/04* (2006.01)

(52) U.S. Cl. ..... 473/334; 473/335; 473/345; 473/349

(58) Field of Classification Search ..... 473/324–350, 473/287–292

See application file for complete search history.

(56) References Cited

U.S. PATENT DOCUMENTS

| | | | |
|---|---|---|---|
| 1,349,806 | A | 8/1920 | Booth |
| 1,361,258 | A | 12/1920 | Horton |
| 1,412,650 | A | 4/1922 | Booth |
| 1,452,845 | A | 4/1923 | Pryde |
| 1,455,379 | A | 5/1923 | Allen |
| 1,552,297 | A | 9/1925 | Harness |
| 1,559,299 | A | 10/1925 | Barach |
| 1,574,213 | A | 2/1926 | Tyler |
| 1,575,364 | A | 3/1926 | Hodgkins |
| 1,705,997 | A | 3/1929 | Williams |
| 3,166,320 | A | 1/1965 | Onions |
| 3,556,533 | A | 1/1971 | Hollis |
| 3,941,390 | A | 3/1976 | Hussey |
| 3,966,210 | A | 6/1976 | Rozmus |
| D240,644 | S | 7/1976 | Manfrin |
| 3,985,363 | A | 10/1976 | Jepson et al. |

(Continued)

FOREIGN PATENT DOCUMENTS

JP 08-089603 4/1996

(Continued)

OTHER PUBLICATIONS

European Search Report for European application No. 10013627.4-2318, dated Mar. 11, 2011, in 8 pages.

(Continued)

*Primary Examiner* — Sebastiano Passaniti

(74) *Attorney, Agent, or Firm* — Mark S. Leonardo; Brown Rudnick LLP

(57) ABSTRACT

A hollow golf club head with a concave portion is disclosed and claimed. The club head includes a metallic portion and a light weight portion, which may be formed of plastic, composite, or the like. The concave portion allows the club designer to make a club head having very thin portions while still maintaining the requisite structural integrity. Convex bulges may optionally be provided to house weight inserts to enhance the playing characteristics of the golf club.

20 Claims, 2 Drawing Sheets

U.S. PATENT DOCUMENTS 4,021,047 A 5/1977 Mader
4,043,563 A 8/1977 Churchward
4,085,934 A 4/1978 Churchward
4,193,601 A 3/1980 Reid, Jr. et al.
D262,049 S 11/1981 Simmons
4,432,549 A 2/1984 Zebelean
4,438,931 A 3/1984 Motomiya
4,653,756 A 3/1987 Sato
4,762,322 A 8/1988 Molitor et al.
4,792,140 A 12/1988 Yamaguchi et al.
4,869,507 A 9/1989 Sahm
4,872,683 A 10/1989 Doran et al.
4,872,685 A 10/1989 Sun
4,883,275 A 11/1989 Broone
4,930,781 A * 6/1990 Allen ..... 473/346
5,186,465 A 2/1993 Chorne
5,205,560 A 4/1993 Hoshi et al.
5,213,328 A 5/1993 Long et al.
5,255,913 A 10/1993 Tsuchida
5,272,802 A 12/1993 Stites, III
5,310,186 A 5/1994 Karsten
5,346,217 A 9/1994 Tsuchiya et al.
5,435,558 A 7/1995 Iriarte
5,447,309 A 9/1995 Vincent
5,464,216 A * 11/1995 Hoshi et al. ..... 473/349
5,474,297 A 12/1995 Levin
5,484,155 A 1/1996 Yamawaki et al.
5,518,240 A * 5/1996 Igarashi ..... 473/345
5,547,188 A 8/1996 Dumontier et al.
5,624,331 A 4/1997 Lo et al.
5,665,014 A 9/1997 Sanford et al.
5,769,736 A 6/1998 Sato
5,785,609 A 7/1998 Sheets et al.
5,797,176 A 8/1998 Rose et al.
5,842,935 A 12/1998 Nelson
5,935,020 A 8/1999 Stites et al.
5,947,840 A 9/1999 Ryan
5,997,415 A 12/1999 Wood
D418,885 S 1/2000 Wanchena
6,012,989 A 1/2000 Saksun
6,059,669 A 5/2000 Pearce
6,074,308 A 6/2000 Domas
6,077,171 A 6/2000 Yoneyama
6,089,994 A 7/2000 Sun
6,123,627 A 9/2000 Antonious
6,139,446 A 10/2000 Wanchena
6,149,534 A 11/2000 Peters et al.
6,162,133 A 12/2000 Peterson
6,183,377 B1 2/2001 Liang
6,217,461 B1 4/2001 Galy
6,248,025 B1 6/2001 Murphy et al.
6,248,026 B1 6/2001 Wanchena
6,254,494 B1 7/2001 Hasebe et al.
6,332,848 B1 12/2001 Long et al.
6,340,337 B2 1/2002 Hasebe et al.
6,354,962 B1 3/2002 Galloway et al.
6,409,612 B1 6/2002 Evans et al.
6,422,951 B1 7/2002 Burrows
6,440,009 B1 8/2002 Guibaud et al.
6,471,604 B2 10/2002 Hocknell et al.
6,482,106 B2 11/2002 Saso
6,565,452 B2 5/2003 Helmstetter et al.
6,572,491 B2 6/2003 Hasebe et al.
6,575,845 B2 6/2003 Galloway et al.
6,592,468 B2 7/2003 Vincent et al.
6,602,149 B1 * 8/2003 Jacobson ..... 473/329
6,623,378 B2 9/2003 Beach et al.
6,645,086 B1 11/2003 Chen
6,648,773 B1 11/2003 Evans
6,716,114 B2 4/2004 Nishio
6,739,983 B2 5/2004 Helmstetter et al.
6,739,984 B1 5/2004 Ciasullo
6,773,360 B2 8/2004 Willett et al.
6,776,723 B2 8/2004 Bliss et al.
6,860,818 B2 3/2005 Mahaffey et al.
6,872,152 B2 3/2005 Beach et al.
6,890,267 B2 5/2005 Mahaffey et al.
6,896,625 B2 5/2005 Grace
6,902,497 B2 6/2005 Deshmukh et al.
6,913,546 B2 7/2005 Kakiuchi
6,926,615 B1 8/2005 Souza et al.
6,929,565 B2 8/2005 Nakahara et al.
6,932,875 B2 8/2005 Cheng et al.
6,955,612 B2 10/2005 Lu
6,988,956 B2 1/2006 Cover et al.
6,991,555 B2 1/2006 Reese
6,991,558 B2 1/2006 Beach et al.
7,008,332 B2 3/2006 Liou
7,022,030 B2 4/2006 Best et al.
7,025,692 B2 4/2006 Erickson et al.
7,041,005 B2 * 5/2006 Beach et al. ..... 473/345
7,070,517 B2 7/2006 Cackett et al.
7,128,664 B2 10/2006 Onoda et al.
7,140,974 B2 11/2006 Chao et al.
7,147,573 B2 12/2006 DiMarco
7,160,040 B2 1/2007 Matsushima
7,163,468 B2 1/2007 Gibbs et al.
7,166,038 B2 1/2007 Williams et al.
7,166,040 B2 1/2007 Hoffman et al.
7,169,060 B2 1/2007 Stevens et al.
7,175,541 B2 2/2007 Lo
7,186,190 B1 3/2007 Beach et al.
7,204,768 B2 4/2007 Nakahara et al.
7,252,599 B2 8/2007 Haseguwa
7,258,625 B2 8/2007 Kawaguchi et al.
7,281,993 B2 10/2007 Oyama
7,303,487 B2 12/2007 Kumamoto
7,338,390 B2 3/2008 Lindsay
D567,888 S 4/2008 Soracco
7,371,191 B2 5/2008 Sugimoto
7,377,860 B2 5/2008 Breier et al.
7,491,131 B2 2/2009 Vinton
7,524,249 B2 4/2009 Breier et al.
7,530,901 B2 5/2009 Imamoto et al.
7,549,933 B2 6/2009 Kumamoto
7,632,195 B2 12/2009 Jorgensen
7,658,686 B2 2/2010 Soracco
7,753,809 B2 7/2010 Cackett et al.
7,803,065 B2 9/2010 Breier et al.
7,938,740 B2 5/2011 Breier et al.
7,980,964 B2 7/2011 Soracco
8,038,545 B2 * 10/2011 Soracco ..... 473/345
2001/0001302 A1 5/2001 Murphy et al.
2001/0049310 A1 12/2001 Cheng et al.
2002/0045490 A1 4/2002 Ezawa et al.
2002/0077195 A1 6/2002 Carr et al.
2002/0137576 A1 9/2002 Dammen
2002/0160858 A1 10/2002 Lee
2003/0045371 A1 3/2003 Wood et al.
2003/0100381 A1 5/2003 Murphy et al.
2003/0134690 A1 7/2003 Chen
2003/0144078 A1 7/2003 Setokawa et al.
2003/0162608 A1 8/2003 Chen
2004/0138002 A1 7/2004 Murray
2004/0176177 A1 9/2004 Mahaffey et al.
2004/0192468 A1 9/2004 Onoda et al.
2004/0242343 A1 12/2004 Chao et al.
2004/0254030 A1 12/2004 Nishitani et al.
2005/0119070 A1 6/2005 Kumamoto
2005/0159243 A1 7/2005 Chuang
2005/0170907 A1 8/2005 Saso
2005/0215354 A1 9/2005 Kumamoto
2005/0272527 A1 12/2005 Sugimoto
2006/0014592 A1 1/2006 Sugimoto
2006/0052177 A1 3/2006 Nakahara et al.
2006/0052181 A1 3/2006 Serrano et al.
2006/0100032 A1 5/2006 Imamoto et al.
2006/0116218 A1 6/2006 Burnett et al.
2007/0054751 A1 3/2007 Breier et al.
2007/0265109 A1 11/2007 Elmer
2008/0070721 A1 3/2008 Chen et al.
2008/0227564 A1 9/2008 Breier et al.
2008/0242445 A1 10/2008 Mergy et al.
2008/0261715 A1 10/2008 Carter
2008/0268980 A1 10/2008 Breier et al.
2009/0118034 A1 5/2009 Yokota
2009/0186717 A1 7/2009 Stites

| | | | |
|---|---|---|---|
| 2009/0203465 | A1 | 8/2009 | Stites |
| 2010/0041490 | A1 | 2/2010 | Boyd et al. |
| 2010/0105499 | A1 | 4/2010 | Roach et al. |
| 2010/0130305 | A1 | 5/2010 | Soracco |
| 2011/0053706 | A1 | 3/2011 | Breier et al. |

FOREIGN PATENT DOCUMENTS

| | | |
|---|---|---|
| JP | 09-192269 | 7/1997 |
| JP | 2000-024149 | 1/2000 |
| JP | 2002-336389 | 11/2002 |
| JP | 2003-093554 | 4/2003 |
| JP | 2003-310808 | 11/2003 |
| JP | 2004-121744 | 4/2004 |
| JP | 2004-159680 | 6/2004 |
| JP | 2004-337327 | 12/2004 |
| JP | 2006-025929 | 2/2006 |
| JP | 2006-130065 | 5/2006 |
| WO | WO 2004-052472 | 6/2004 |
| WO | WO 2007/101350 | 9/2007 |

OTHER PUBLICATIONS

Jackson, Jeff, The Modern Guide to Golf Clubmaking. Ohio: Dynacraft Golf Products, Inc. copyright 1994, p. 239.

Japanese Office Action for Application No. 2007-311561, dated Jun. 30, 2010, in 7 pages.

Japanese Office Action titled Pretrial Reexamination Report for Japanese Application No. 2007-085624, (Appeal Trial No. 2010-009497), dated Jul. 7, 2010, in 6 pages.

* cited by examiner

GOLF CLUB HEAD WITH CONCAVE INSERT

CROSS-REFERENCE TO RELATED APPLICATIONS

This application is a continuation of U.S. patent application Ser. No. 12/696,468, filed Jan. 29, 2010, which is a continuation of U.S. patent application Ser. No. 11/110,733, filed Apr. 21, 2005, issued as U.S. Pat. No. 7,658,686, the entire disclosure of each of which is incorporated by reference herein.

BACKGROUND OF THE INVENTION

1. Field of the Invention

The present invention relates to a golf club, and, more particularly, the present invention relates to a large wood-type golf club head with a concave insert.

2. Description of the Related Art

Golf club heads come in many different forms and makes, such as wood- or metal-type (including drivers and fairway woods), iron-type (including wedge-type club heads), utility- or specialty-type, and putter-type. Each of these styles has a prescribed function and make-up. The present invention primarily relates to hollow golf club heads, such as wood-type and utility-type (generally referred to herein as wood-type golf clubs).

Wood-type type golf club heads generally include a front or striking face, a crown, a sole, and an arcuate skirt including a heel, a toe, and a back. The crown and skirt are sometimes referred to as a "shell." The front face interfaces with and strikes the golf ball. A plurality of grooves, sometimes referred to as "score lines," may be provided on the face to assist in imparting spin to the ball. The crown is generally configured to have a particular look to the golfer and to provide structural rigidity for the striking face. The sole of the golf club contacts and interacts with the ground during the swing.

The design and manufacture of wood-type golf clubs requires careful attention to club head construction. Among the many factors that must be considered are material selection, material treatment, structural integrity, and overall geometrical design. Exemplary geometrical design considerations include loft, lie, face angle, horizontal face bulge, vertical face roll, face size, sole curvature, center of gravity, and overall head weight. The interior design of the club head may be tailored to achieve particular characteristics, such as by including hosel or shaft attachment means, perimeter weighting on the face or body of the club head, and fillers within hollow club heads. Club heads typically are formed from stainless steel, aluminum, or titanium, and are cast, stamped as by forming sheet metal with pressure, forged, or formed by a combination of any two or more of these processes. The club heads may be formed from multiple pieces that are welded or otherwise joined together to form a hollow head, as is often the case of club heads designed with inserts, such as sole plates or crown plates. The multi-piece constructions facilitate access to the cavity formed within the club head, thereby permitting the attachment of various other components to the head such as internal weights and the club shaft. The cavity may remain empty, or may be partially or completely filled, such as with foam. An adhesive may be injected into the club head to provide the correct swing weight and to collect and retain any debris that may be in the club head. In addition, due to difficulties in manufacturing one-piece club heads to high dimensional tolerances, the use of multi-piece constructions allows the manufacture of a club head to a tight set of standards.

It is known to make wood-type golf clubs out of metallic materials. These clubs were originally manufactured primarily by casting durable metals such as stainless steel, aluminum, beryllium copper, etc. into a unitary structure comprising a metal body, face, and hosel. As technology progressed, it became more desirable to increase the performance of the face of the club, usually by using a titanium material.

With a high percentage of amateur golfers constantly searching for more distance on their shots, particularly their drives, the golf industry has responded by providing golf clubs specifically designed with distance in mind. The head sizes of wood-type golf clubs have increased, allowing the club to possess a higher moment of inertia, which translates to a greater ability to resist twisting on off-center hits.

SUMMARY OF THE INVENTION

The present invention relates to a large wood-type golf club head with a concave insert. The club head is formed of a plurality of body members that define an interior volume. A first body member is made of a metallic material and includes a sale portion and a face portion. A second body portion is made of a light weight material, such as plastic, composite, or a very thin sheet of low density metallic material. The second body portion makes up at least a portion of the club head skirt, and includes one or more concave indentations that extend into the interior volume of the club head. These indentations provide structural integrity to the second body portions, which may be very thin panels.

The second body member optionally may also include one or more convex bulges that generally extend away from the interior volume. Inserts, such as weight inserts, may be positioned within the convex bulges. Careful positioning of the weight inserts allows the designer to enhance the playing characteristics of the golf club and tailor the club for a specific swing type. The first body member may form a large portion of the club head sole, and the second body member may form a large portion of the club head crown. This weight positioning further enhances the playing characteristics of the golf club.

DESCRIPTION OF THE DRAWINGS

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
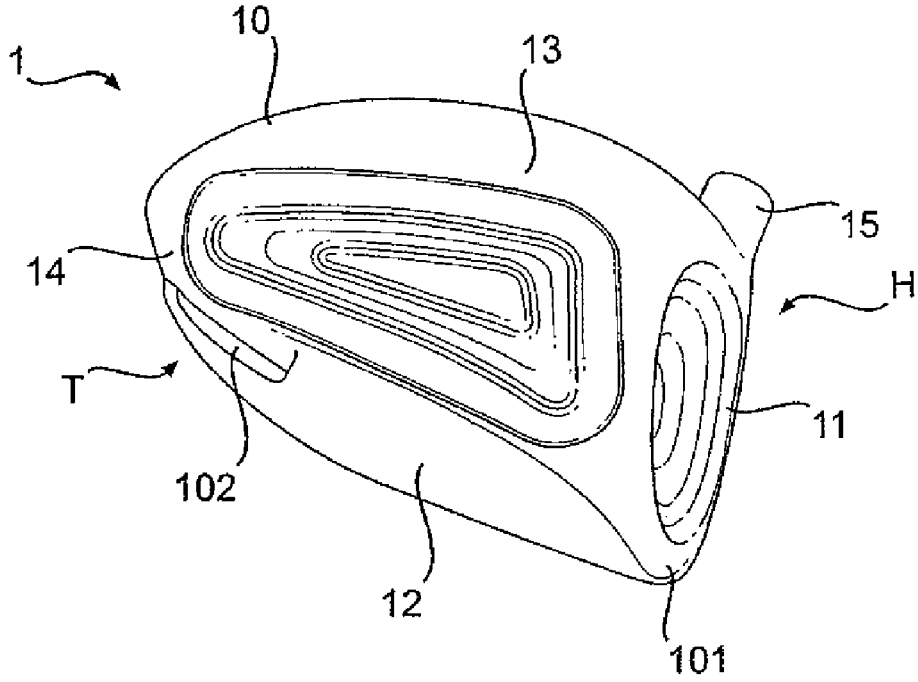
FIG. 1 shows a golf club head of the present invention.

FIG. 1 shows a golf club head 1 of the present invention. The club head 1 includes a body 10 having a strike face 11, a sole 12, a crown 13, a skirt 14, and a hosel 15. The body 10 defines a hollow, interior volume 16. Foam or other material may partially or completely fill the interior volume 16. Weights may optionally be included within the interior volume 16. The face 11 maybe provided with grooves or score lines therein of varying design. The club head 1 has a toe T and a heel H.

Figure 2:
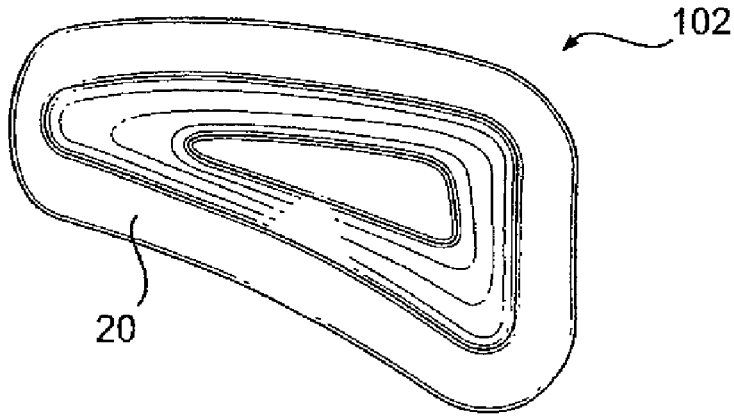
FIG. 2 shows a body member of the golf club head of FIG. 1.

The club head 1 is comprised of a plurality of body members that cooperatively define the interior volume 16. A first body member 101 includes a sole portion and a face portion. The first body member may include a complete face 11 and sole 12. Alternatively, either or both the face 11 and the sole 12 can be inserts coupled to the first body member 101. The club head 1 also includes at least one second body member 102 coupled to the first body member 101 along the skirt 14 in known fashion. The crown 13 can be unitarily a portion of either body member 101, 102 or it may be an insert coupled to either of the body members 101, 102. The second body member 102 includes a concave portion 20 that, when the body members 101, 102 are coupled together, extends inward into the interior volume 16. FIG. 2 shows an isolated view of an exemplary second body member 102.

The first body member 101 preferably is formed of a metallic material such as stainless steel, aluminum, or titanium. The material of the first body member 101 is chosen such that it can withstand the stresses and strains incurred during a golf swing, including those generated through striking a golf ball or the ground. The club head 1 can be engineered to create a primary load bearing structure that can repeatedly withstand such forces. Other portions of the club head 1, such as the skirt 14, experience a reduced level of stress and strain and advantageously can be replaced with a lighter, weight-efficient secondary material. Lighter weight materials, such as low density metal alloys, plastic, composite, and the like, which have a lower density or equivalent density than the previously mentioned metallic materials, can be used in these areas, beneficially allowing the club head designer to redistribute the "saved" weight or mass to other, more beneficial locations of the club head 1. These portions of the club head 1 can also be made thinner, enhancing the weight savings. Exemplary uses for this redistributed weight include increasing the overall size of the club head 1, expanding the size of the club head "sweet spot," which is a term that refers to the area of the face 11 that results in a desirable golf shot upon striking a golfball, repositioning the club head 1 center of gravity, and/or produce a greater moment of inertia (MOI). Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases, making the club more forgiving for off-center hits since less energy is lost during impact from club head twisting. Moving or rearranging mass to the club head perimeter enlarges the sweet spot and produces a more forgiving club. Increasing the club head size and moving as much mass as possible to the extreme outermost areas of the club head 1, such as the heel H, the toe T, or the sole 12, maximizes the opportunity to enlarge the sweet spot or produce a greater MOI, making the golf club hotter and more forgiving.

The second body member 102 is light-weight, which gives the opportunity to displace the club head center of gravity downward and to free weight for more beneficial placement elsewhere without increasing the overall weight of the club head 1. When the wall thickness of the second body member 102 is at the minimum range of the preferred thickness, a reinforcing body layer can be added in the critical areas in case the member shows deformations. These benefits can be further enhanced by making the second body member 102 thin. To ensure that the structural integrity of the club head 1 is maintained, these thin panels may preferably include a concave portion 20. Inclusion of these concave portions 20 allow the second body member 102 to withstand greater stress—both longitudinally and transversely—without sustaining permanent deformation or affecting the original cosmetic condition, ensuring the structural integrity of the club head 1 is maintained. Preferred thicknesses for the first body member 101 include from 0.03 inch to 0.05 inch, while preferred thicknesses for the second body member 102 include from 0.015 inch to 0.025 inch. Preferably, the concave portion 20 displaces at least 10 cubic centimeters. More preferably, the concave portion 20 displaces at least 25 cubic centimeters. While the club head 1 can be virtually any size, preferably it is a legal club head. A plurality of concave portions 20 may be used with the club head 1. For example, concave portions 20 of uniform or varying size may be positioned in the toe, heel, back, etc.

Figure 3:
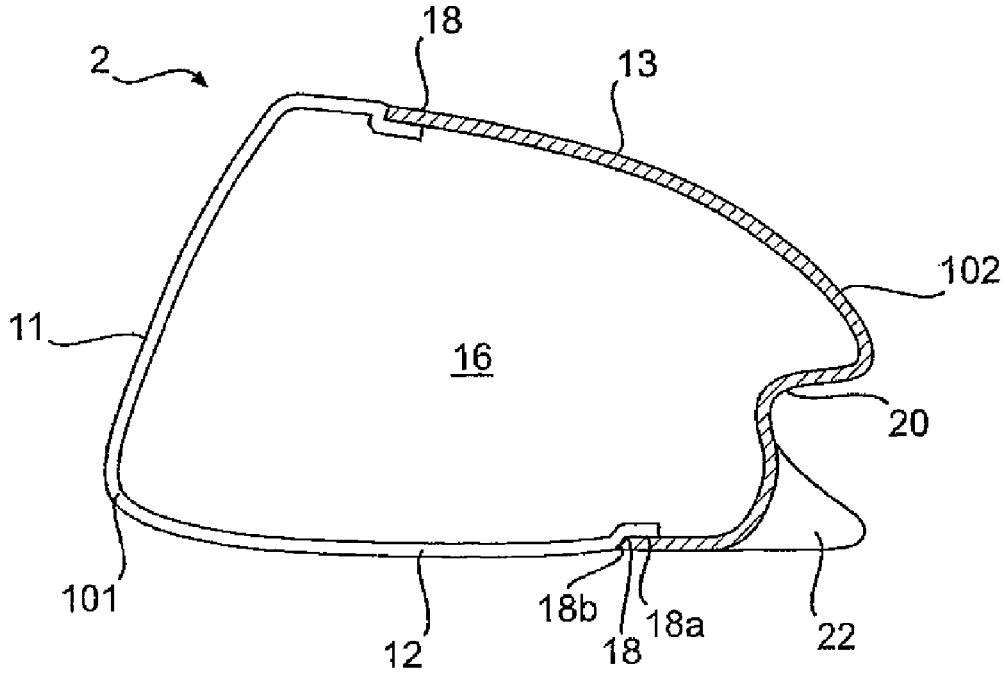
FIG. 3 shows a second club head of the present invention.
Figure 4:
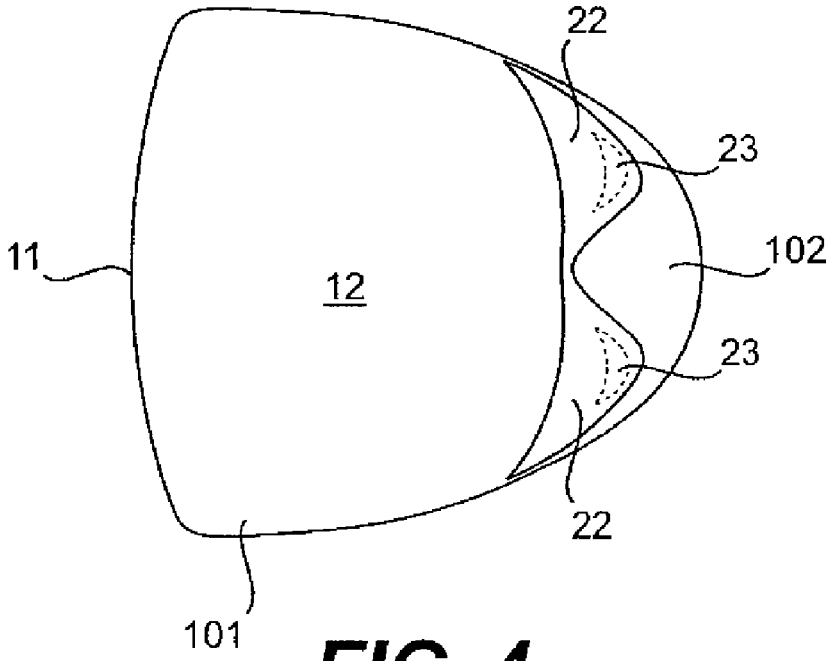
FIG. 4 shows a bottom view of the club head of FIG. 3.

FIG. 3 shows a cross-sectional view taken substantially perpendicular to the face 11 of a second club head 2 of the present invention, and FIG. 4 shows a bottom view of the club head 2. In the illustration of this embodiment, the concave portion 20 is positioned at the back of the club head 2. The concave portion 20 preferably is not visible to the golfer at address. In addition to the concave portion 20, the second body member 102 further includes a convex bulge 22 that extends generally away from the interior volume 16. An insert 23 may be positioned within the convex bulge. The insert 23 is not visible from outside the club head 2, and is thus illustrated using broken lines. In a preferred embodiment, the insert 23 is a weight insert. The convex nature of the bulge 23 allows the weight to be positioned to maximize the mechanical advantage it lends to the club head 2. As shown in FIG. 4, the club head 2 may include a plurality of convex bulges 22, such as on a heel side and on a toe side of the club head 2. The club designer may place inserts 23 as desired within the bulges 22. The masses of the inserts may be substantially equal. Alternatively, one of the inserts may have a greater mass than the other. This may be beneficial to design the club to correct a hook swing or a slice swing. A preferred mass range for the weight insert 23 is from 1 gram to 50 grams.

As shown in FIG. 3, the first body member 101 may comprise a majority of the sole 12 and the second body member 102 may include a majority of the crown 13. This beneficially removes a large majority of the mass from the upper part of the club head 2. In this embodiment the first body member 101 includes an attachment perimeter 18 that extends around its edge. The second body member 102 is coupled to the first body member 101 along the attachment perimeter 18. The first and second body members 101, 102 cooperatively define the interior volume 16. The attachment perimeter 18 preferably may contain a step defining two attachment surfaces 18*a*, 18*b*. As illustrated, the second body member 102 maybe coupled to both of these surfaces 18*a*, 18*b* to help ensure a strong bond between the body members 101, 102.

While the body members 101, 102 may be formed in a variety of manners, a preferred manner includes forming a complete club head shell (first body member 101) in known manner and removing material to create openings to which the second body member 102 can be coupled. The opening may be created in any desired manner, such as with a laser. The second body member 102 may be joined to the first body member 101 in a variety of manners, such as through bonding or through a snap-fit in conjunction with bonding. If a composite material is used for the concave inserts, molding six plies of 0/90/45/-45/90/0 is preferred.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. For example, while two body members have been described above, the present invention may be embodied in a club head having more than two body members. Additionally, the present invention may be embodied in any type of club in addition to the wood-type clubs shown in the illustrated embodiments. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

What is claimed is:

1. A golf club head comprising a plurality of body members cooperatively defining an interior volume, wherein the plurality of body members comprise:

a first body member comprising a portion of a crown of the club head, the entire ball striking face of the club head, and a portion of a sole of the club head;

a second body member comprising a portion of the crown of the club head, and a portion of sole of the club head, the second body member attached to the first body member along an attachment perimeter along the club head;

wherein the first body member is comprised of a metallic material, and the second body member is comprised of a material lighter in density than the metallic material of the first body member; and wherein the second body member comprises at least one weight insert, and at least one empty concave indentation extending towards the interior volume and not visible to a golfer at address.

2. The golf club of claim 1, wherein the at least one weight insert has a mass between 1 gram and 50 grams.

3. The golf club of claim 1 wherein the second body member further comprises a convex bulge that extends generally away from the interior volume.

4. The golf club of claim 3, wherein the weight insert is inside of the convex bulge.

5. The golf club of claim 3 wherein the second body member further comprises a second convex bulge that extend generally away from the interior volume.

6. The golf club of claim 5, wherein the convex bulge is on a heel side and the second convex bulge is on a toe side of the club head.

7. The golf club of claim 5, wherein the weight insert is in the convex bulge, and further wherein the second body member comprises a second weight insert in the second convex bulge.

8. The golf club of claim 7, wherein a mass of the weight insert is different from a mass of the second weight insert.

9. The golf club of claim 1, wherein the second body member further comprises a second weight insert.

10. The golf club of claim 9, wherein a mass of the second weight insert is greater than a mass of the first weight insert.

11. The golf club of claim 1, wherein the concave indentation displaces at least 25 cubic centimeters of the interior volume.

12. The golf club of claim 1, wherein the attachment perimeter comprises a step defining two attachment surfaces.

13. A golf club head comprising a plurality of body members cooperatively defining an interior volume, wherein the plurality of body members comprise:

a first body member comprising a portion of a crown of the club head, the entire ball striking face of the club head, and a portion of a sole of the club head;

a second body member comprising a portion of the crown of the club head, a portion of a skirt of the club head, and a portion of sole of the club head, the second body member attached to the first body member along an attachment perimeter along the club head;

wherein the first body member is comprised of a metallic material, and the second body member is comprised of a material lighter in density than the metallic material of the first body member; and wherein the second body member comprises:

at least one concave indentation extending towards the interior volume and displacing at least 10 cubic centimeters of an interior volume of the club head;

a convex bulge that extends generally away from the interior volume; and at least one weight insert inside of the convex bulge and not visible from outside of the club head.

14. The golf club of claim 13 wherein the concave indentation is not visible to a golfer at address.

15. The golf club of claim 13, wherein the second body member further comprises a plurality of convex bulges.

16. The golf club of claim 15, wherein one of the plurality of convex bulges is on a heel side of the club head and one of the plurality of convex bulges is on a toe side of the club head.

17. The golf club of claim 16 wherein the second body member comprises:

a weight insert having a mass inside of the heel side convex bulge; and a second weight insert having a second mass inside of the toe side convex bulge, and wherein one of the mass and the second mass is greater than the other.

18. The golf club of claim 13, wherein the concave indentation is empty and further comprising an additional empty concave indentation.

19. The golf club of claim 18, wherein the concave indentations are of uniform size.

20. The golf club of claim 18, wherein the concave indentations are of varying size.

* * * * *